US005077839A

United States Patent [19]

Keller

[11] Patent Number: 5,077,839

[45] Date of Patent: Jan. 7, 1992

[54] HELMET CHAIN STRAP BUCKLE

[75] Inventor: Steven C. Keller, Island Lake, Ill.

[73] Assignee: Illinois Tool Works Inc., Glenview, Ill.

[21] Appl. No.: 562,832

[22] Filed: Aug. 6, 1990

[51] Int. Cl.[5] ..... A42B 7/00

[52] U.S. Cl. ..... 2/421; 24/200; 24/315

[58] Field of Search ..... 2/421, 410, 425; 24/172, 173, 197, 200, 311, 315

[56] References Cited

U.S. PATENT DOCUMENTS

| | | | |
|---|---|---|---|
| 473,458 | 4/1892 | Harris | 24/315 |
| 560,670 | 5/1896 | Adams | 24/662 |
| 734,263 | 7/1903 | Hickok | 24/315 |
| 825,395 | 7/1906 | Kennelly et al. | 24/197 |
| 1,136,107 | 4/1915 | Croasdale | 24/315 |
| 1,327,199 | 1/1920 | Cleary | 24/619 |
| 2,989,274 | 6/1961 | Moran | 24/311 |
| 3,542,426 | 11/1970 | Radke | 24/573.1 |
| 3,572,329 | 3/1971 | Woskin | 2/421 |
| 3,845,524 | 11/1974 | Hull et al. | 24/546 |
| 4,044,400 | 8/1977 | Lewicki et al. | 2/421 |
| 4,110,847 | 9/1978 | Dera | 2/421 |
| 4,335,472 | 6/1982 | Rappleyea | 2/421 |
| 4,398,306 | 8/1983 | Gooding | 2/421 |
| 4,434,514 | 3/1984 | Sundahl et al. | 2/421 |
| 4,461,044 | 7/1984 | Reiterman et al. | 2/421 |
| 4,559,679 | 12/1985 | Downey | 2/421 |
| 4,622,700 | 11/1986 | Sundahl | 2/425 |
| 4,641,382 | 2/1987 | Gessalin | 2/421 |
| 4,653,123 | 3/1987 | Broersma et al. | 2/425 |
| 4,897,888 | 2/1990 | Broersma et al. | 2/421 |
| 4,901,373 | 2/1990 | Broersma | 2/421 |

*Primary Examiner*—Werner H. Schroeder
*Assistant Examiner*—Michael A. Neas
*Attorney, Agent, or Firm*—Schwartz & Weinrieb

[57] ABSTRACT

A chin strap buckle for securing a protective helmet to a wearer's head includes a female snap fastener member and a male snap fastener member which snappingly interlock together at their respective one ends in a pivotal relationship. The female member is formed of a substantially triangularly-shaped mid-portion and left and right end portions formed integrally with the opposite sides of the mid-portion. The mid-portion has a trough-like recess formed at its top. The male snap fastener member is formed of a triangular body portion and a lower end portion. The body portion has a post extending outwardly therefrom adjacent its top. The post has an enlarged button and a neck connecting the button to the body portion. The neck of the body portion of the male member is snappingly received within the trough-like recess formed at the top of the female member for interlocking the male and female members together. Stop members are formed upon the female member for limiting the rotational or punctual movement of the male member relative to the female member.

20 Claims, 3 Drawing Sheets

HELMET CHAIN STRAP BUCKLE

BACKGROUND OF THE INVENTION

1. Field of the Invention

This invention relates generally to chin strip attachment devices and more particularly, it relates to an improved helmet chin strap buckle used in conjunction with a chin strap for securing protective headgear such as, for example a helmet to a wearer's head.

2. Description of the Prior Art L- A prior art search directed to the subject matter of this application in the U.S. Patent and Trademark Office revealed the following U.S. Letters Patent:

| | |
|---|---|
| 560,670 | 3,572,329 |
| 734,263 | 3,845,524 |
| 769,037 | 4,335,472 |
| 825,395 | 4,398,306 |
| 1,327,199 | 4,461,044 |
| 3,542,426 | 4,641,382 |

In U.S. Pat. No. 825,395 to Michael J. Kennelly et al. issued on July 10, 1906, there is disclosed a garment supporter comprised of a clasp member 2 and a runner 3 pivotally secured to the clasp member by means of a rivet 5. In U.S. Pat. No. 1,327,199 to Edward Cleary issued on Jan. 6, 1920, there is shown a two-piece cast-off for suspenders, stocking supporters and the like which is formed of a ball member 10 and a socket member 11. The ball member has a rounded boss 17 which is receivable within a rounded socket 19 formed within the socket member.

In U.S. Pat. No. 3,542,426 to Donald G. Radke issued on Nov. 24, 1970, there is disclosed a shoulder harness connector for coupling a shoulder belt 28 to a pair of lap belts 18 and 20 of a vehicle seatbelt system. The shoulder harness connector includes a tongue 24 connected to lap belt segment 18 and a plate 30 connected to the shoulder harness belt 28. The tongue carries a post 34 and the plate carries a slot 32 adapted to interlockingly receive the post. The tongue and the plate are free to swivel relative to one another through 360° or more of rotation.

U.S. Pat. No. 4,641,382 to Jean Gessalia issued on Feb. 10, 1987, teaches a helmet fastening device formed of male and female members pivotally connected together at one end and having stop means at the other end so as to limit the arcuate movement defined between the two members. The two members can relatively fixed with respect to each other due to the interengagement of the teeth and pinion rack 12 and the corresponding teeth of catch 15.

The remaining patents uncovered from the search but not specifically discussed merely show the state of the art relating to strap buckle systems for both helmets and for use with other devices and are thus considered to be only of general interest.

However, none of the prior art uncovered in the search discloses a helmet chin strap buckle like that of the present invention which accommodates three straps and is formed of male and female snap fastener members which snappingly interengage at their one end in a pivotal relationship. The female snap fastener member includes a trough-like recess, and the male snap fastener member includes a neck which is snappingly receivable within the trough-like recess for interlocking the male and female members together. The female snap fastener member is provided with stop means for limiting the rotational movement of the male member relative to the female member.

OBJECTS OF THE INVENTION

Accordingly, it is a general object of the present invention to provide a improved helmet chin strap buckle which is relatively simple and economical to manufacture and assemble.

It is another object of the present invention to provide an improved helmet chin strap buckle which includes male and female fastener members that snappingly engage and stop means formed upon the female member so as to permit limited pivoting movement of the male member relative to the female member so as to accommodate different facial structures of the wearers.

It is another object of the present invention to provide an improved helmet chin strap buckle which includes male and female fastener members that snappingly engage so as to facilitate quick connection and disconnection thereof.

It is still another object of the present invention to provide an improved helmet chin strap buckle which includes a female fastener member formed of a substantially triangularly-shaped mid-portion having a trough-like recess disposed at its top and a male fastener member being formed of a triangular body portion having a post for being snappingly receivable within the trough-like recess of the female fastener member for interlocking the male and female fastener members together.

SUMMARY OF THE INVENTION

In accordance with these aims and objectives, the present invention is concerned with the provision of an improved helmet chin strap buckle for securing a protective helmet to a wearer's head which includes front and rear retention strap sections, a chin strap retention section, a female snap fastener member, and a male snap fastener member. Each of the front and rear retention strap sections has a first end thereof attached to the helmet. The chin strap retention section is adapted to engage the wearer's chin and terminates at free ends. The female snap fastener member is formed of a substantially triangularly-shaped mid-portion and left and right end portions formed integrally with the opposite sides of the mid-portion. The left end portion has a first plurality of spaced-apart, parallel slots within which the second end of one of the front and rear retention strap sections is insertable and movable for strap length adjustment. The right end portion has a second plurality of spaced-apart, parallel slots within which the second end of the other one of the front and rear retention strap sections is insertable and movable for strap length adjustment. The mid-portion has a trough-like recess formed at its top.

The male snap fastener member is formed of a triangular body portion and a lower end portion. The lower end portion has a third plurality of spaced-apart, parallel slots within which one of the free ends of the chin strap retention section is insertable and movable for strap length adjustment. The body portion has a post extending outwardly therefrom adjacent its top. The post has an enlarged button and a neck connecting the button to the top part of the body portion. The neck of the body portion of the male member is snappingly receivable within the trough-like recess formed at the top of the female member for interlocking the male and female fastener members together. Stop means are formed upon the female member for limiting the rotational movement of the male member relative to the female member.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout the several views, and wherein.

DESCRIPTION OF THE PREFERRED EMBODIMENT

Figure 1:
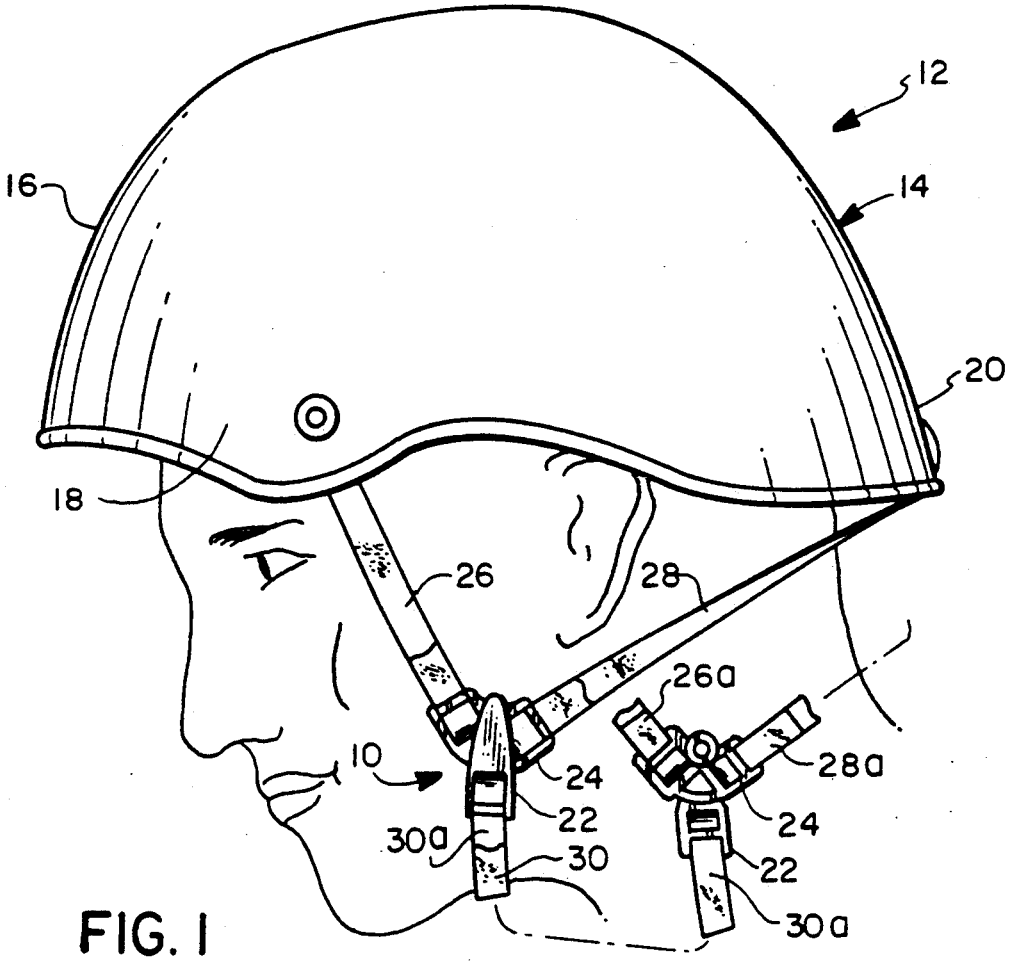
FIGS. 1 and 1A are perspective views of a helmet chin strap buckle constructed in accordance with the principles of the present invention and used in conjunction with a protective helmet.

Referring now in detail to the drawings, there is shown in FIG. 1 a helmet chin strap buckle 10 constructed in accordance with the present invention and used in conjunction with protective headgear, such as, for example, a helmet 12. Although the headgear 12 is illustrated in the form of a military helmet, it should be clearly understood that the principles of the invention may be utilized in connection with any other suitable protective headgear, such as, for example a cyclist's helmet, a policeman's helmet, a hockey helmet, a baseball helmet and the like. The helmet 12 has an outer shell 14 which is preferably made of a relative rigid material, such as, for example polycarbonate alloy, a rigid thermoplastic, or the like. The outer shell 14 includes an upper central portion 16, a front portion 18, and a rear portion 20.

The helmet chin strap buckle 10 is comprised of a male snap fastener member 22 and a female snap fastener member 24 which snappingly interengage at a respective one end thereof in accordance with a pivotal relationship defined therebetween as will become more apparent hereinafter. A left front helmet retention strap section 26 and a first rear helmet retention strap section 28 are looped at their respective one ends through opposite ends of the female fastener member 24. The other ends of the strap sections 26 and 28 are suitably attached to the helmet front and rear portions 18 and 20, respectively. A chin strap retention section 30 has its one end looped through the male fastener member 22. Of course, it will be apparent that a buckle 10 of the same type is used for connection with a right front helmet retention strap section **26*a* and a second rear helmet retention strap section 28*a* for connection with the other side of the chin strap 30 for attaching the chin strap to the helmet 10 (FIG. 1). The upper ends of the respective left front, right front and rear retention strap sections 26, 26*a*, 28 and 28*a*** can be suitably secured to the helmet by any number of conventional means, such as, for example, by means of rivets, buckles and the like.

With reference to FIGS. 2–7, there is shown in detail the male and female snap fastener members 22 and 24. Both the male snap fastener member 22 and the female snap fastener member 24 may be preferably formed by injection molding of a high impact resistant plastic material which is slightly flexible and resilient. The female snap fastener member 24 of FIGS. 4 and 5 includes a specially-contoured aperture 32 which coacts with the stud or button 34 formed upon the male snap fastener member 22 of FIGS. 6 and 7, as will be more fully described hereinafter.

The female member 24 includes a substantially triangularly-shaped mid-portion 36 and end portions 38, 40 formed integrally with the opposite sides of the mid-portion 36. The top of the mid-portion 36 has positioned thereon the trough-like recess or aperture 32 which is defined upon each side by crescent-shaped sections **42*a*, 42*b*. Each of the crescent-shaped sections 42*a*, 42*b* is provided with a downwardly scalloped surface 44 so as to accommodate retention of the fingers of the wearer so as to facilitate disconnection of the male member from the female member. The end portion 38 includes a plurality of spaced-apart, parallel slots 46, 48 and 50 within which one end of the left front helmet retention strap section 26 is insertable, and the end portion 40 includes a plurality of spaced-apart, parallel slots 52, 54 and 56 within which one end of the first rear helmet retention strap, section 28** is insertable and movable in a looped manner for strap length adjustment and retaining the female fastener member.

At the side opposite the top of the mid-portion 36, there is provided an arcuate surface 60 of a predetermined radius which is defined by means of left and right shoulder portions **62*a*, 62*b*. At the apex of the triangularly-shaped mid-portion 36, there is provided a downwardly inclined surface 61 which is defined upon each side thereof by means of left and right upstanding wall sections 63*a*, 63*b*. The shoulder portions and upstanding wall sections function as stop means for limiting the rotational movement of the male member 22 relative to the female member 24**, as will be more fully described herein.

The male fastener member 22 includes a substantially triangular body portion 64 having a integral post 66 extending outwardly from its underneath surface adjacent the top thereof. The post 66 has the enlarged stud or button 34 and a neck 68 which supports the button below the underneath surface of the body portion 64. While the button is illustrated with a circular configuration, it could, however, have other geometrical shapes. The width of the gap 70 across the top of the trough-like recess 32 defined within the female fastener member 24 is less than the diameter of the neck 68 so that as the neck is passed through the gap 70 and into the recess 32 the sides of the recess are urged resiliently outwardly.

Once the neck 68 is passed through the gap 70, the sides of the recess will resiliently flex inwardly so as to interlock the male and female members together. Furthermore, the recess 32 has a diameter which is smaller than the diameter of the button 34 but is slightly greater than the diameter of the neck 68 so that the button cannot pass through the recess 32 from the underneath side of the mid-portion 36 to its top side. As a result, the neck 68 is fully received within the recess 32. Because the recess has a diameter slightly greater than the diameter of the neck, the neck 68 can freely rotate about its axis to a limited extent within the recess 32.

At the side opposite the top of the body portion 64, there is integrally formed a lower end portion 72 having a plurality of spaced-apart, parallel slots 74, 76 and 78 within which one of the free ends of the chin strap section 30 is insertable and movable in a looped manner for strap retention and retaining the male fastener member. As can best be seen from FIG. 7, the underneath surface of the body portion 64 is provided with a rib-like member 65 which is defined upon each side by means of left and right sloping wall sections 67*a*, 67*b*. The rib-like member 65 is integrally formed with the middle portion of the neck 68 and is engageable with the inclined surface 61 of the mid-portion 36 of the female member 24.

Figure 3A:
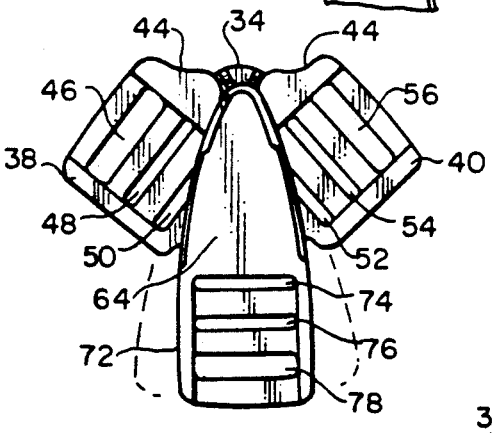
FIG. 3A is a view of the male and female members of FIG. 3 being interengaged, with the dotted lines indicating the limited pivotal movement of the male member relative to the female member.
Figure 3:
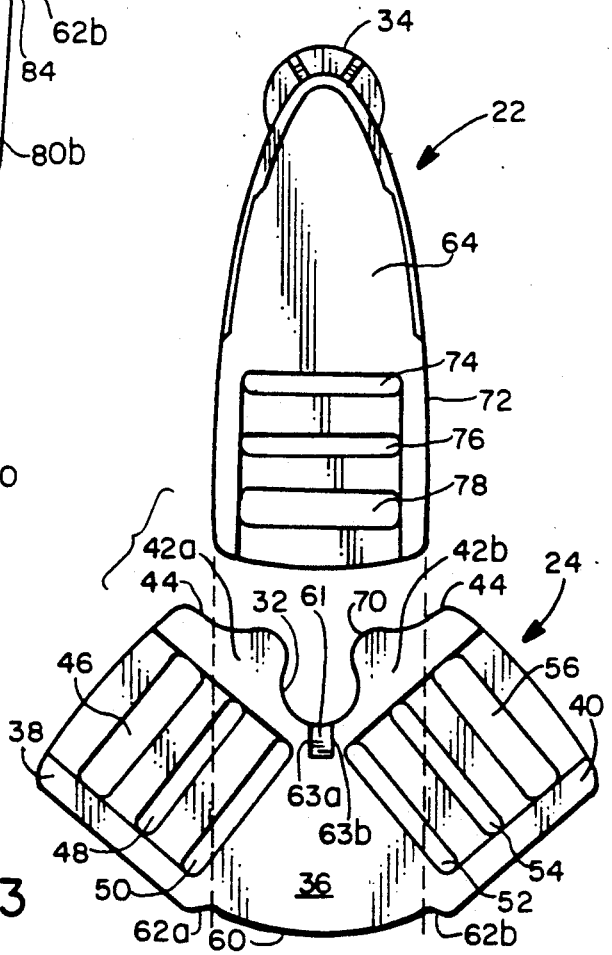
FIG. 3 is an exploded view of the chin strap buckle of FIG. 2.
Figure 4:
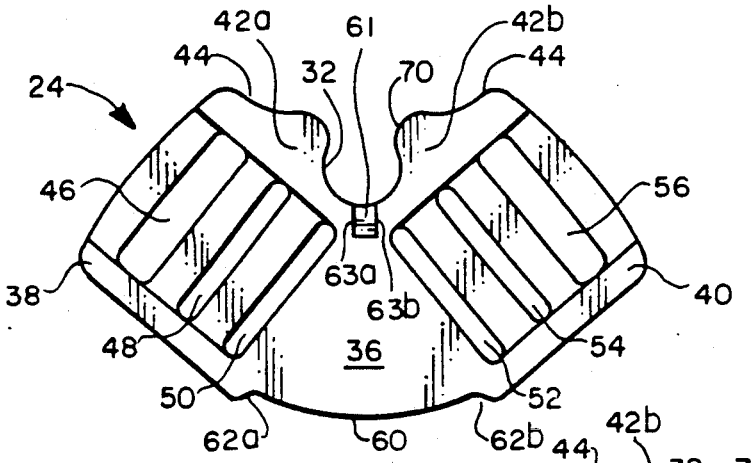
FIG. 4 is a side elevational view of the female fastener member of the strap buckle.
Figure 5:
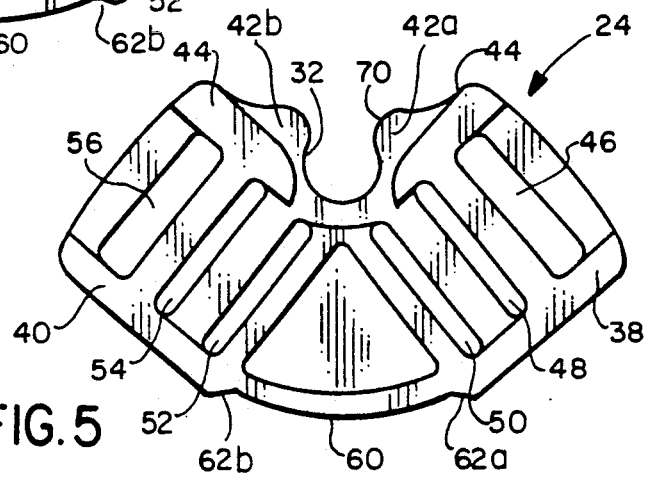
FIG. 5 is an opposite side elevational view of the female fastener member of FIG. 4.
Figure 6:
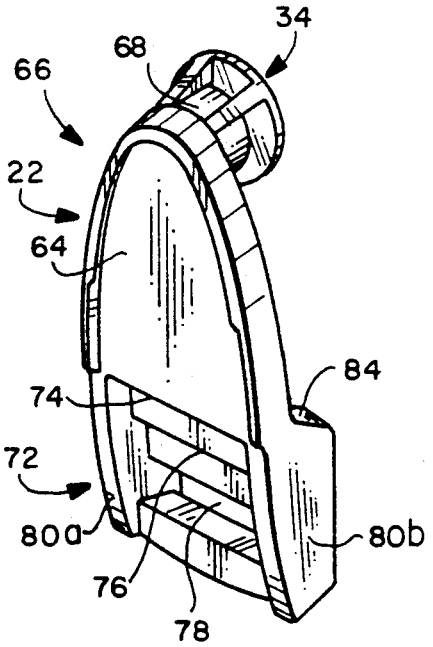
FIG. 6 is a perspective view of the male fastener member of the strap buckle.
Figure 7:
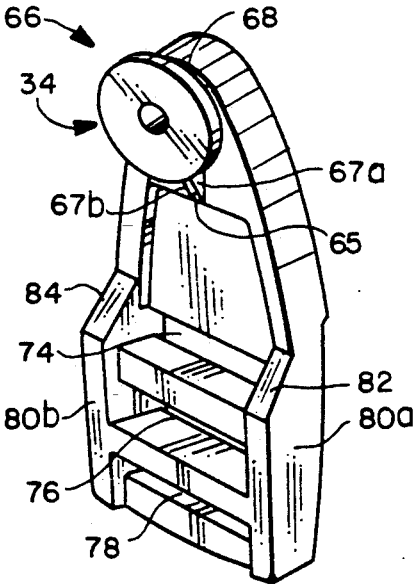
FIG. 7 is perspective view of the male member of the strap buckle of FIG. 6, taken from an opposite side perspective viewpoint.

The end portion 72 of male member 22 includes vertical 14 extending side walls 80*a*, 80*b* disposed parallel to each other. The vertical side walls 80*a*, 80*b* are provided with respective angular side edges 82, 84 which will abut left and right shoulder portions 62*a*, 62*b* of female fastener member 24 depending upon the direction of pivoting or swivelling movement of the male member 22 relative to the female member 24. Simultaneously, the left and right sloping wall sections 67*a*, 67*b* will abut the left and right upstanding wall sections 63*a*, 63*b* of female fastener member 24 depending upon the rotational or pivotal movement of the male member relative to the female member. The amount of rotational or pivotal movement is limited to approximately 10° which is shown by means of the dotted lines in FIG. 3A. This limited rotational or pivotal movement functions to accommodate adjustability, different facial or bone structures of the wearers of the helmet, and the like.

Figure 1A:
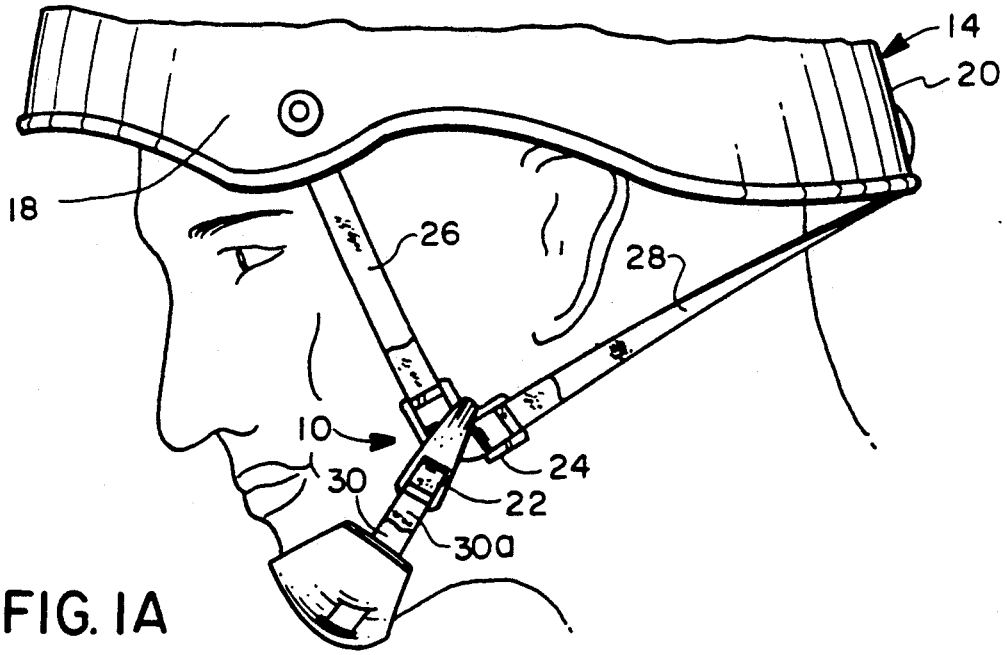
Figure 2:
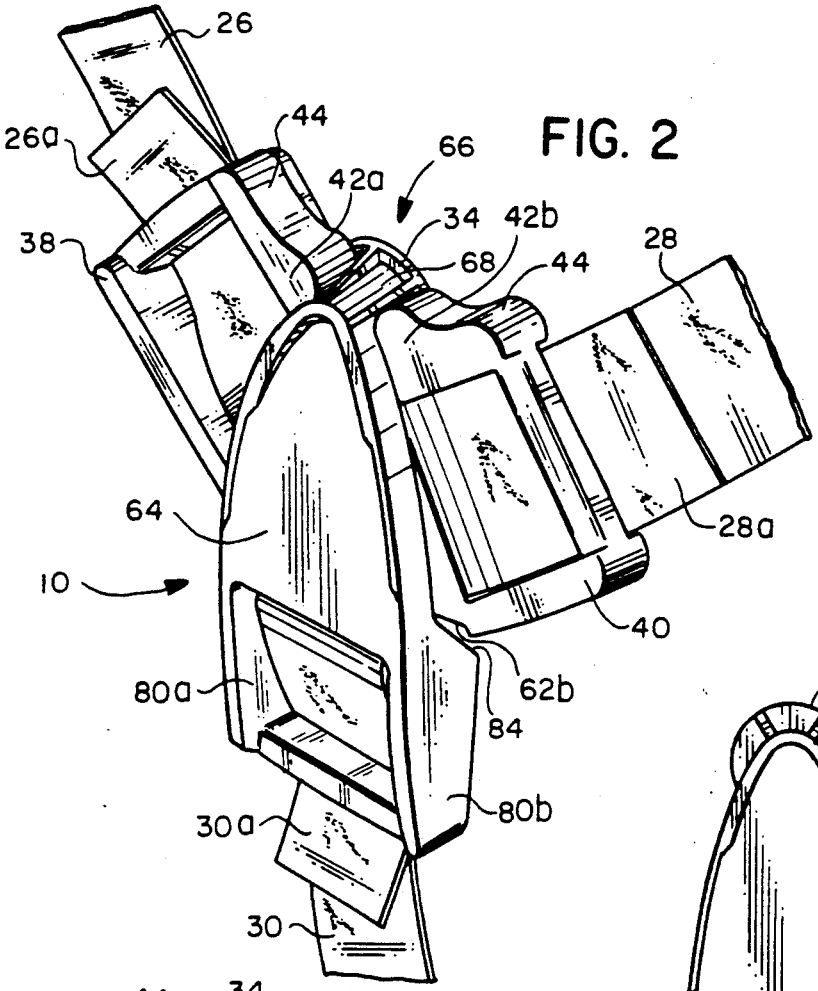
FIG. 2 is an enlarged, fragmentary perspective view of the helmet chin strap buckle of FIG. 1.

In operation of the helmet chin strap buckle 10, the helmet 12 is properly positioned upon the wearer's head and the chin strap retention section 30 is looped through the end portion 72 of the male member as shown in FIGS. 1, 1A and 2. Next, the neck 68 of the male member is positioned so as to fit into the gap 70 of the female member 24. By pulling downwardly upon the lower part of the end portion 72 of the male member, the neck 68 will pass through the gap 70 of the female member recess portion 32 and will be fully received within the trough-like recess 32 so as to snappingly interlock the male and female members together as previously described.

In order to remove the helmet 12 from the head of the wearer, it is only required to place the index fingers of each hand into the scalloped surfaces 44 of the female member 24 and to push upwardly with the two thumbs upon the lower part of the end portion 72 of the male member 22, as illustrated in FIG. 2. As a result, the angular side edges 82, 84 will cam up onto the mid-portion 36 of the female member and the neck of the male member 68 will be forced out of the recess of the female member so as to effect a quick disconnection so as to permit easy removal of the helmet. The male and female members provide a quick connect-disconnect feature which frees the wearer from having to re-adjust the end portion 30*a* of the chin strap each time the helmet is put on.

From the foregoing detailed description, it can thus be seen that the present invention provides a helmet chin strap buckle formed of male and female snap fastener members which snappingly interconnect at their respective one ends in a pivotal relationship. Furthermore, stop members are formed upon the female fastener member for limiting the rotational or pivotal movement of the male member relative to the female member.

While there has been illustrated and described what is at present considered to be a preferred embodiment of the present invention, it will be understood by those skilled in the art that various changes and modifications may be made, and equivalents may be substituted for element thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A helmet chin strap buckle for securing a protective helmet to a wearer's head, comprising in combination:

front and rear retention strap sections, each having a first end thereof attached to said helmet, and a second end;

a chin strap retention section for engaging a chin portion of said wearer and terminating at free ends;

a female snap fastener member being formed of a mid-portion, and left and right end portions formed integrally with opposite sides of said mid-portion;

said left end portion having at least one slot within which said second end of one of said front and rear retention strap sections is insertable for strap length adjustment;

said right end portion having at least one slot within which said second end of the other one of said front and rear retention strap sections is insertable for strap length adjustment;

said mid-portion having a trough-like recess formed within a top region thereof;

a male snap-fastener member being formed of a body portion and a lower end portion;

said lower end portion having at least one slot within which one of said free ends of said chin strap retention section is insertable for strap length adjustment;

said body portion having a post extending outwardly therefrom adjacent its top, said post having an enlarged button and a neck connecting said button to said body portion;

said neck of said body portion of said male member being snappingly engageable within said trough-like recess formed within said top region of said female member for interlocking said male and female members together in a pivotable mode whereby said lower end portion of said male member, and said chin strap retention section inserted therein, can pivotably move with respect to said female member and said front and rear retention strap sections inserted therein; and stop means formed upon said female member for limiting said pivotable movement of said male member, and said chin strap retention section inserted therein, relative to said female member, and said front and rear retention strap sections inserted therein, within a predetermined range.

2. A helmet chin strap buckle as claimed in claim 1, wherein the diameter of said trough-like recess is smaller than the diameter of said button so as to prevent said button from passing therethrough.

3. A helmet chin strap buckle as claimed in claim 2, wherein the diameter of said trough-like recess is slightly greater than the diameter of said neck so as to permit free pivotable movement of said male member relative to said female member within said trough-like recess.

4. A helmet chin strap buckle as claimed in claim 3, wherein said mid-portion of said female member and said body portion of said male member are formed with a substantially triangular shape.

5. A helmet chin strap buckle as claimed in claim 4, wherein said stop means is comprised of shoulder portions disposed upon ends of a side disposed opposite the top of said mid-portion for engagement with angular side edges formed upon the lower end portion of said male member, and upstanding wall sections disposed upon opposite sides of an inclined surface at the apex of said mid-portion for engagement with a rib-like member formed upon the underneath surface of said body portion of said male member so as to limit said pivotable movement of said neck within said trough-like recess.

6. A helmet chin strap buckle as claimed in claim 1, wherein said male and female members are formed by injection molding of a plastic material.

7. A helmet chin strap buckle as claimed in claim 1, further comprising crescent-shaped sections disposed upon each side of said trough-like recess, each section having a downwardly scalloped surface so as to accommodate retention of the fingers of said wearer so as to facilitate disconnection of the male member from the female member.

8. A helmet retention system as set forth in claim 1, wherein:

said left and right end portions of said female member, and said lower end portion of said male member, comprise three slots within which said respective strap retention sections may be selectively inserted so as to achieve said strap length adjustment.

9. A helmet retention system as set forth in claim 5, wherein:

said side of said female member disposed opposite said top of said mid-portion has an arcuate configuration so as to permit said pivotable movement of said male member thereon.

10. A helmet retention system as set forth in claim 1, wherein:

said trough-like recess includes a gap portion having a width which is less than the diameter of said neck of said body portion such that said neck of said body portion is snappingly engaged into said trough-like recess.

11. A helmet retention system as set forth in claim 1, wherein:

said predetermined range is approximately 10°.

12. A helmet retention system used in conjunction with a chin strap for securing a helmet to a wearer's head, comprising:

a female snap fastener member being formed of a mid-portion, and left and right end portions integrally formed with opposite sides of said mid-portion, said mid-portion having a trough-like recess formed within a top region thereof;

a male-snap fastener member being formed of a body portion and a lower end portion, said body portion having a post extending outwardly therefrom adjacent a top portion thereof, said post having an enlarged button and a neck connecting said button to said body portion;

said neck of said body portion of said male member being snappingly engageable within said trough-like recess formed within said top region of said female member for interlocking said male and female members together in a pivotable mode whereby said lower end portion of said male member can pivotably move with respect to said female member; and stop means formed upon said female member for limiting said pivotable movement of said male member relative to said female member within a predetermined range.

13. A helmet retention system as claimed in claim 12, wherein the diameter of said trough-like recess is smaller than the diameter of said button so as to prevent said button from passing therethrough.

14. A helmet retention system as claimed in claim 13, wherein the diameter of said trough-like recess is slightly greater than the diameter of said neck so as to permit free pivotable movement of said male member relative to said female member within said trough-like recess.

15. A helmet retention system as claimed in claim 14, wherein said mid-portion of said female member and said body portion of said male member are formed with a substantially triangular shape.

16. A helmet retention system as claimed in claim 15, wherein said stop means is comprised of shoulder portions disposed upon ends of a side disposed opposite the top of said mid-portion for engagement with angular side edges formed upon said lower end portion of said male member, and upstanding wall sections disposed upon opposite sides of an inclined surface at the apex of said mid-portion for engagement with a rib-like member formed upon the underneath surface of said body portion of said male member so as to limit said pivotable movement of said neck within said trough-like recess.

17. A helmet retention system as claimed in claim 12, wherein said male and female members are formed by injection molding of a plastic material.

18. A helmet retention system as claimed in claim 12, further comprising crescent-shaped sections disposed upon each side of said trough-like recess, each section having a downwardly scalloped surface so as to accommodate retention of the fingers of said wearer so as to facilitate disconnection of the male member from the female member.

19. A helmet retention system as set forth in claim 12, wherein:

said side of said female member disposed opposite said top of said mid-portion has an arcuate configuration so as to permit said pivotable movement of said male member thereon.

20. A helmet retention system as set forth in claim 8, wherein:

said trough-like recess includes a gap portion having a width which is less than the diameter of said neck of said body portion such that said neck of said body portion is snappingly engaged into said trough-like recess.

* * * * *